United States Patent [19]

Ebesu et al.

[11] Patent Number: 5,074,255

[45] Date of Patent: Dec. 24, 1991

[54] V-SHAPED ENGINE

[75] Inventors: Hidesaku Ebesu, Hiroshima; Masakazu Tokuyama, Aki; Masami Nishida, Higashihiroshima, all of Japan

[73] Assignee: Mazda Motor Corporation, Hiroshima, Japan

[21] Appl. No.: 707,337

[22] Filed: May 29, 1991

[30] Foreign Application Priority Data

Jun. 5, 1990 [JP] Japan ..... 2-59718[U]
Apr. 10, 1991 [JP] Japan ..... 3-23579[U]

[51] Int. Cl.[5] ..... F02B 75/18

[52] U.S. Cl. ..... 123/41.74; 123/41.44; 123/55 V; 123/198 C

[58] Field of Search ..... 123/41.01, 41.1, 41.29, 123/41.44, 41.47, 41.74, 55 V, 55 VF, 55 VS, 55 VE, 195 A, 198 R, 198 C

[56] References Cited

U.S. PATENT DOCUMENTS 3,730,147 5/1973 Buchwald ..... 123/195 A
4,448,159 5/1984 Hidaka et al. ..... 123/198 C

FOREIGN PATENT DOCUMENTS 262315 10/1989 Japan ..... 123/41.01

*Primary Examiner*—Noah P. Kamen
*Attorney, Agent, or Firm*—Fish & Richardson

[57] ABSTRACT

A V-shaped engine has an inlet passage and an outlet passage for coolant. The inlet passage for introducing coolant to a water pump mounted to a front face of a cylinder block of the engine is arranged vertically in a space between a right bank and a left bank. The outlet passage is so arranged as to pass between a timing belt idler provided forwardly of the space between the right bank and the left bank and the inlet passage. This arrangement of the inlet passage and the outlet passage enables the V-shaped engine to be made compact.

12 Claims, 6 Drawing Sheets

V-SHAPED ENGINE

BACKGROUND OF THE INVENTION AND RELATED ART STATEMENT

The present invention relates to a V-shaped engine having a passage structure for coolant.

Conventionally, there has been known a coolant passage structure for use in a V-shaped engine provided with an outlet passage projecting forwardly of front faces of a right bank and a left bank. Such a passage structure is disclosed in, for example, Unexamined Japanese Utility Model Publication No. 62-66215. In the above passage structure, a water pump is provided on a rear side of the engine, and an inlet passage for introducing coolant to the water pump is arranged in a longitudinal direction in a space between right and left banks.

In order to reduce the size of the conventional V-shaped engine having a passage structure for coolant, the following modifications can be considered: The water pump is provided on the front end portion of a cylinder block and the inlet passage for introducing coolant to the water pump is arranged in the front end portion of the engine vertically from upper front portion of the engine to a space between the both banks. In addition, it is considered as a possible modification that an idle pulley for a timing belt is disposed forwardly of the space between both banks.

However, even with these modifications, if the outlet passage is arranged to project forwardly of the right bank and the left bank, the length of the engine will be increased by the projection of the outlet passage. Accordingly, the engine cannot be made maximally compact.

SUMMARY OF THE INVENTION

In view of the above drawbacks, it is an object of the present invention to provide a V-shaped engine having a smaller size.

Accordingly, a V-shaped engine of the present invention comprises a cylinder block, a pair of a first bank and a second bank, the pair having a V-shape in respect of a crosswise plane thereof, the first bank being formed by a first cylinder head and a first top half portion of the cylinder block supporting the first cylinder, the second bank being formed by a second cylinder head and a second top half portion of the cylinder block supporting the second cylinder, a water pump provided on a front end portion of the cylinder block, an inlet passage for introducing coolant into the water pump, the inlet passage extending in a vertical direction in a space between the first bank and the second bank, a timing belt idler provided in front of the space, and an outlet passage for discharging the coolant from the first bank and the second bank, the outlet passage extending in a transverse direction over front faces of the first bank and the second bank with passing between the timing belt idler and the inlet passage.

In this construction, the inlet passage is arranged in a vertical direction in a space between the first bank and the second bank, and the outlet passage is arranged so as to pass between the inlet passage and the timing belt idler. Accordingly, a space between the inlet passage and the timing belt idler is utilized more effectively. Thus, the V-shaped engine can be made compact to greater extent.

Also, a V-shaped engine of the present invention comprises a first bank including a first cylinder head, a first row of cylinders, and a first outlet passage for discharging the coolant from the first bank, a second bank including a second cylinder head, a second row of cylinders, and a second outlet passage for discharging the coolant from the second bank, the first row of cylinders and the second row of cylinders being arranged so as to offset to each other in a lengthwise direction of the engine, the second row of cylinders being positioned rearward relative to the first row of cylinders, and a junction portion formed in a portion of the second bank which is in front of the most forward cylinder of the second row, the first outlet passage and the second outlet passage joining into the junction portion.

In this construction, the junction portion is formed in the portion in front of the most forward cylinder of the second row of cylinders being positioned rearward relative to the first row of cylinders. Accordingly, the overall length of the engine can be reduced compared to the conventional V-shaped engine in which an outlet passage is arranged to project forwardly of the front face of the cylinder heads. Thus, the engine can be made compact.

These and other objects, features, and advantages of the present invention will become more apparent upon a reading of the following detailed description and accompanying drawings.

DETAILED DESCRIPTION OF THE INVENTION

Figure 1:
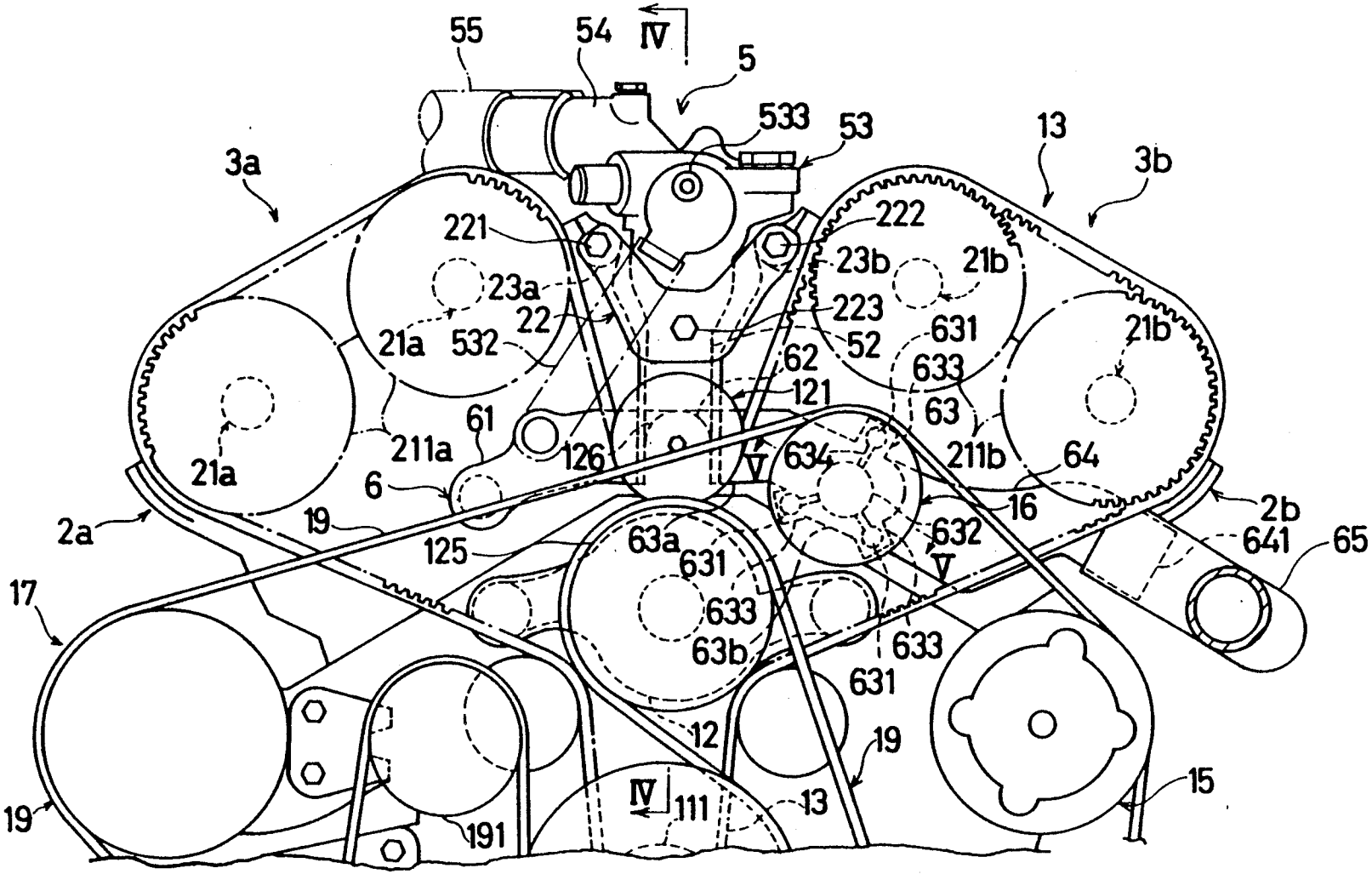
FIG. 1 is a diagram enlargedly showing a front face of a forward upper portion of a V-shaped engine embodying the present invention.
Figure 2:
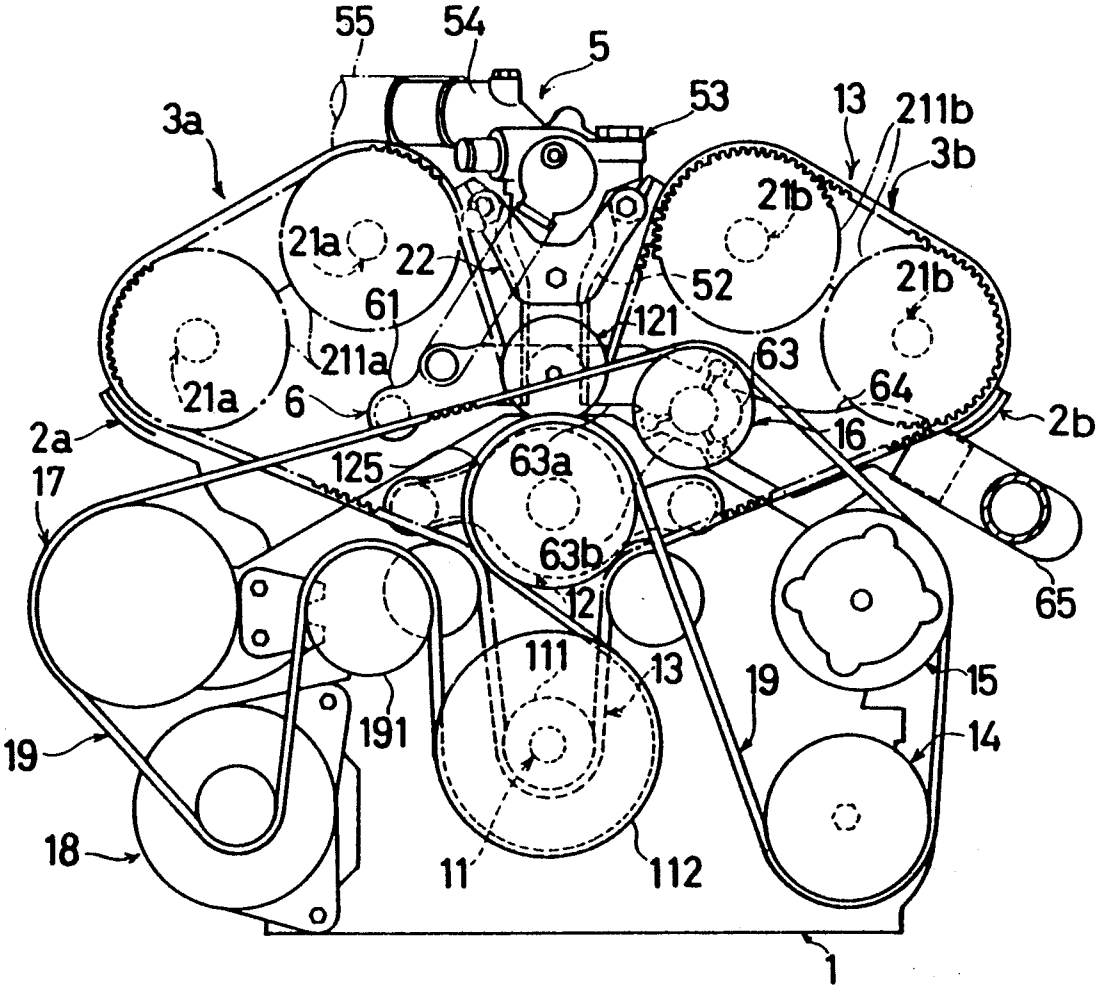
FIG. 2 is a front view showing an overall construction of the V-shaped engine.
Figure 3:
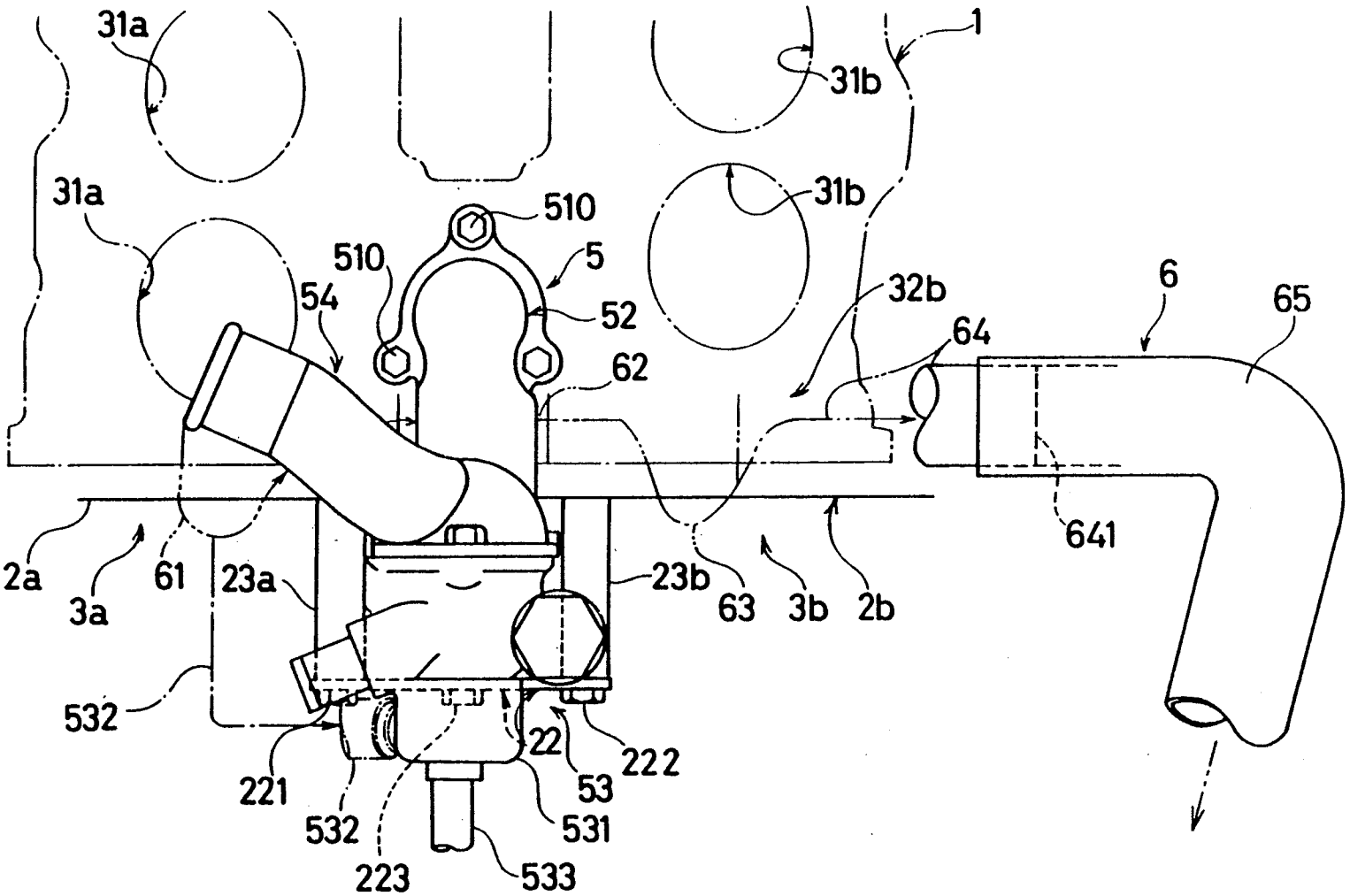
FIG. 3 is a diagram enlargedly showing a top face of the forward upper portion of the V-shaped engine.
Figure 4:
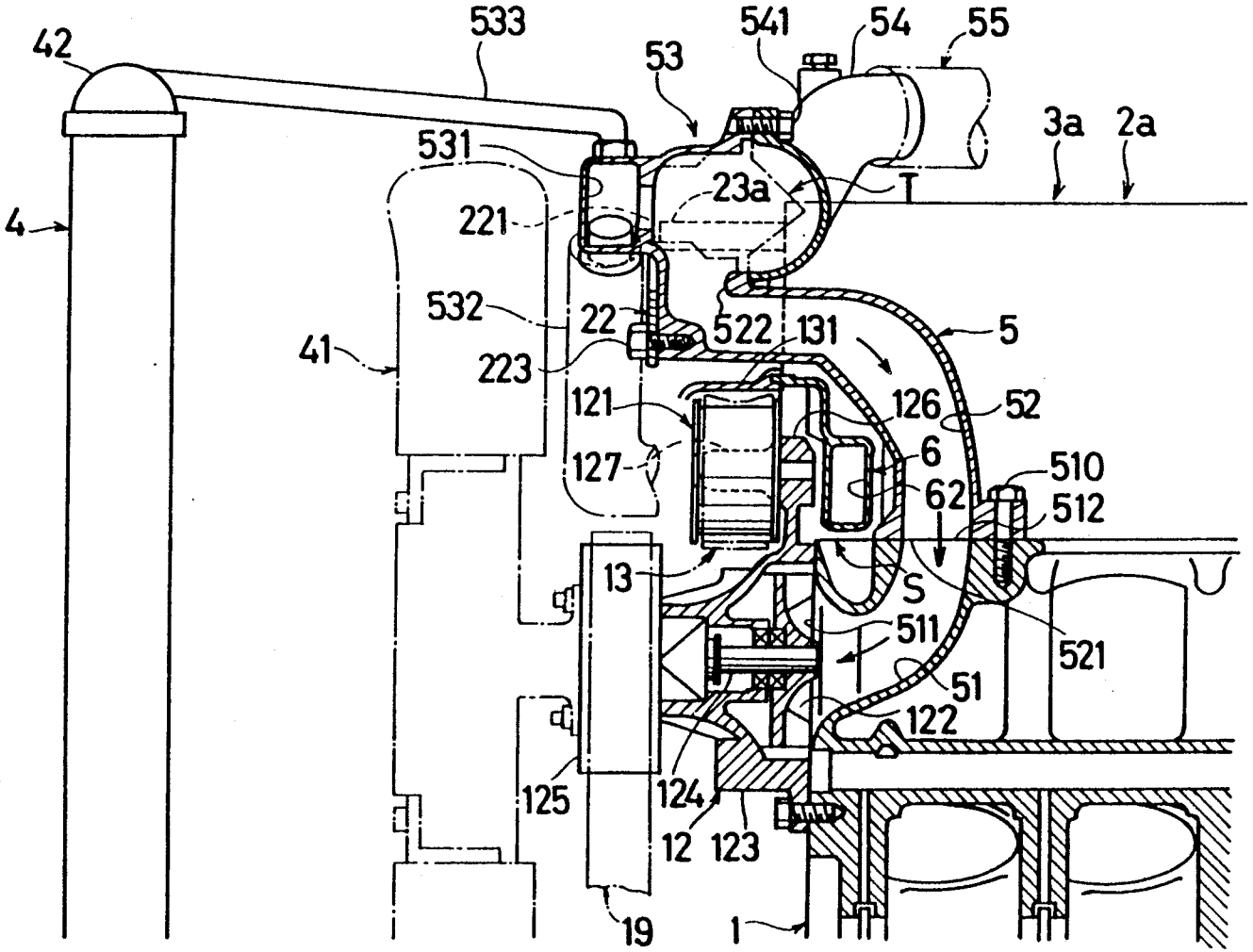
FIG. 4 is a cross-sectional view taken along the line IV—IV in FIG. 1.

A first embodiment of the present invention will be described with reference to FIGS. 1 to 4. FIG. 1 ia a diagram enlargedly showing a front face of a forward upper portion of a V-shaped engine embodying the present invention. FIG. 2 is a front view showing an overall construction of the V-shaped engine. FIG. 3 is a diagram enlargedly showing a top face of the forward upper portion of the V-shaped engine. FIG. 4 is a cross-sectional view taken along the line IV—IV in FIG. 1.

In FIG. 2, indicated at 1 is a cylinder block provided in a V-shaped engine, the cylinder block incorporating a passage structure for coolant. Indicated at 2*a*, 2*b* are a pair of cylinder heads arranged crosswisely and jointly forming a V-shape on top end of the cylinder block 1. The right half of an upper portion of the cylinder block 1 and the cylinder head 2*a*, and the left half of the upper portion of the cylinder block 1 and the cylinder head 2*b* constitute banks 3*a*, 3*b* respectively. In the respective banks 3*a*, 3*b* are formed a plurality of cylinders 31*a*, 31*b* in a train as shown in FIG. 3. The each other, thereby creating an offsetting space 32*b* at forward end portion of the bank 3*b*. Also, forwardly of the cylinder block 1 and the cylinder heads 2*a*, 2*b* is disposed a fan 41 and further forwardly thereof a radiator 4 as shown in FIG. 4.

As shown in FIG. 2, a crank shaft 11 (power output shaft) is rotatably provided in a lower portion of the cylinder block 1 and cam shafts 21*a*, 21*b* are rotatably provided in the cylinder heads 2*a*, 2*b* respectively. At a forward end of the crank shaft 11 projecting forwardly from the cylinder block 1 is disposed a timing pulley 111. At forward ends of the cam shaft 21*a*, 21*b* are disposed timing pulleys 211*a*, 211*b* respectively. A timing belt 13 is wound onto the timing pulleys 111, 211*a*, 211*b* and an idle pulley 121 so as to encircle these pulleys.

At the forward end of the crank shaft 11 is disposed a pulley 112 located forwardly of the timing pulley 111. A belt 19 is wound onto the pulley 112 and various engine accessories, such as a water pump 12, a compressor 14 for air-conditioning, a suspension oil pump 15 for active suspension, a steering oil pump 17 for power steering, an alternator 18. Indicated at 16 and 191 are respectively an idle pulley and a tensioner.

The water pump 12 is mounted substantially in the center of the front face of the cylinder block 1. The water pump 12 is mounted to the cylinder block 1 as shown in FIG. 4 and comprises a pump housing 123 and a rotatable shaft 124. Between the pump housing 123 and the front face of the cylinder block 1 is defined a pumping chamber 122. The rotatable shaft 124 is supported by the pumping chamber 122 and a pumping pulley 125 onto which the belt 19 is wound runs on the rotatable shaft 124 at an end portion thereof. The fan 41 is mounted to the front face of the pumping pulley 125. Also, a support portion 126 is formed at the top portion of the pumping housing 123 projecting upwardly therefrom. The support portion 120 comprises a boss 127 projecting forwardly, and the boss 127 supports the idle pulley 121 onto which the timing belt 13 is wound.

Next, an inlet passage 5 for introducing coolant from the radiator 4 to the water pump 12 will be described. The inlet passage 5 comprises a first inlet passage portion 51, a second inlet passage portion 52, a thermostat housing 53 for containing a thermostat T, an inlet end portion 54, and a radiator hose 55. The inlet end portion 54 is joined to the thermostat housing 53 by a bolt 541. The radiator hose 55 is adapted to connect the inlet end portion 54 and an outlet of the radiator 4.

The first inlet passage portion 51 is integrally defined in the forward portion of the cylinder block 1 and has a downstream end 511 opened to the pumping chamber 122 of the water pump 12. The first inlet passage portion 51 extends obliquely upwardly from the downstream end 511. Where the first inlet passage portion 51 intersects with the top face of the cylinder block 1 is defined an upstream end 512 so as to open to the space between the banks 3*a*, 3*b*.

The second inlet passage portion 52 comprises a tube body integrally formed with the thermostat housing 53 and has a downstream end 521 joined to the upstream end 512 of the first passage portion 51 by a bolt 510 so that the first and the second inlet passage portions 51, 52 communicate with each other. The second inlet passage portion 52 extends forwardly in a smooth curve upwardly from the downstream end 512 through the space between the banks 3*a*, 3*b*. Where the second inlet passage portion 52 intersects with the bottom portion of the thermostat housing 53 is defined a second upstream end 522 through which the second inlet passage portion 52 and the thermostat housing 53 communicate with each other.

The thermostat housing 53 is supported by a bracket 22 mounted on the cylinder heads 2*a*, 2*b*, thereby being positioned above the cylinder heads 2*a*, 2*b* between the banks 3*a*, 3*b* and is disposed to project forwardly of the cylinder heads 2*a*, 2*b*. In the thermostat housing 53, a front chamber 531 is formed forwardly of the thermostat T. The front chamber 531 is connected to an outlet passage 6 (see FIG. 1) to be described below by a by-pass hose 532 extending downwardly from the lower end of the front chamber 531. The upper end of the front chamber 531 and an upper bank 42 of the radiator 4 are connected by a pipe member 533 so as to communicate with each other.

The bracket 22 is formed into a V-shape when viewed from the front as shown in FIG. 1. The opposite ends of the bracket 22 are mounted respectively to mounting seats 23*a*, 23*b* formed to project forwardly of the cylinder heads 2*a*, 2*b* by bolts 221, 222, connecting the cylinder heads 2*a*, 2*b* to each other. A bolt 223 is screwed in the thermostat housing 53 through the center of the bracket 22 as shown in FIGS. 1, 3, and 4. Accordingly, the thermostat housing 53 is supported by the cylinder heads 2*a*, 2*b* by way of the bolt 223 and the bracket 22.

Figure 5:
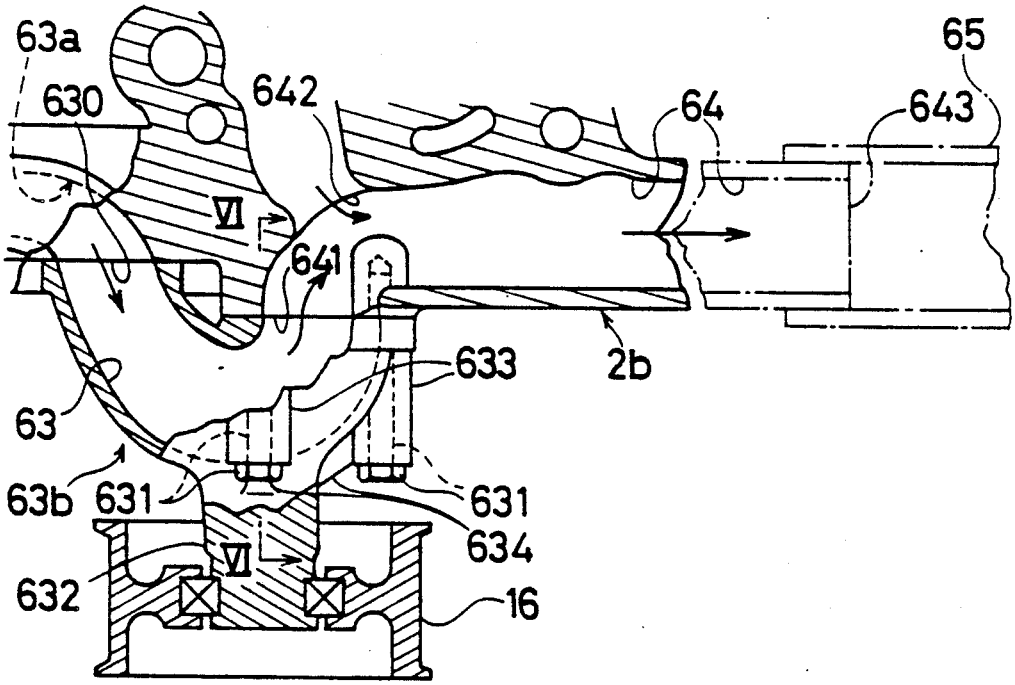
FIG. 5 is an enlarged sectional view taken along the line V—V in FIG. 1.
Figure 6:
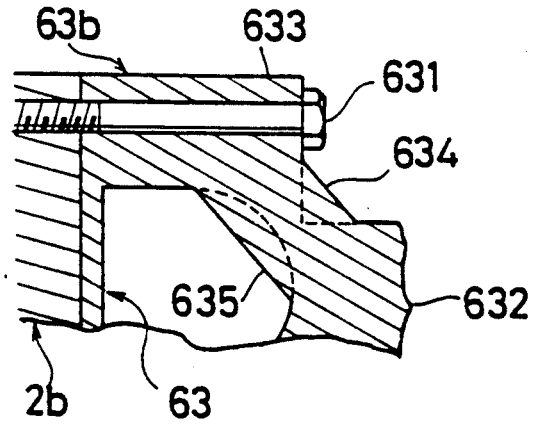
FIG. 6 is an enlarged sectional view taken along the line VI—VI in FIG. 5.
Figure 7:
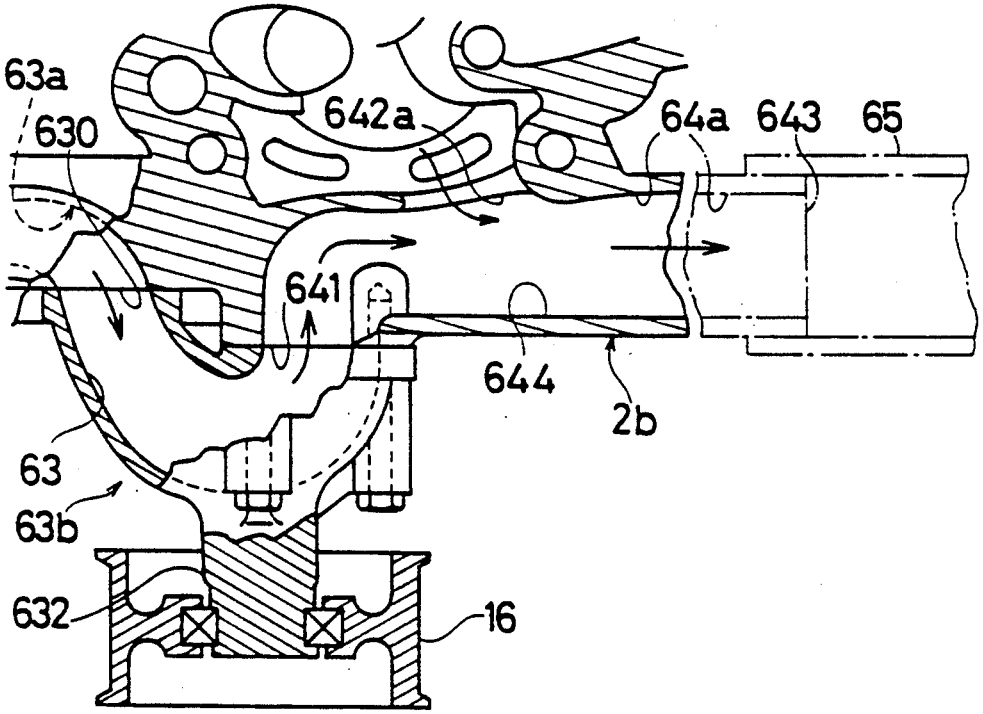
FIG. 7 is a sectional view, similar to FIG. 5, showing a second embodiment of the invention.

The structure of an outlet passage 6 will be described with reference to FIGS. 1 to 7. FIG. 5 is an enlarged sectional view taken along the line V—V in FIG. 1. FIG. 6 is an enlarged sectional view taken along the line VI—VI in FIG. 5. FIG. 7 is a sectional view, corresponding to FIG. 5, showing a second embodiment of the invention.

The coolant supplied from the water pump 12 to the cylinder block 1 passes through unillustrated water jackets in the cylinder heads 2*a*, 2*b* and is brought to the outlet passage 6 arranged forwardly of the cylinder heads 2*a*, 2*b* to be consequently returned to an inlet of the radiator 4. The outlet passage 6 comprises, as shown in FIGS. 1 and 3, a first outlet passage portion 61 leading from the cylinder head 2*a*, a second outlet passage portion 62 lying over the banks 3*a*, 3*b*, a third outlet passage portion 63 convexly projecting forwardly of the cylinder head 2*b*, a fourth outlet passage portion 64 leading up to an outlet end 641 projecting outwardly of the cylinder head 2*b*, an outlet pipe 65 connected to the outlet end 641, and a hose for connecting the outlet pipe 65 and the inlet of the radiator 4. The hose is not illustrated.

The first outlet passage portion 81 is connected to an outlet defined in the cylinder head 2*a* from which the coolant from the water jackets of the cylinder head 2*a* is discharged. Also, the by-pass hose 532 is connected to the first outlet passage portion S1, so that the first outlet passage portion 61 and the front chamber 531 of the thermostat housing 53 communicate with each other. Accordingly, in the case where the temperature of the coolant lies in a predetermined temperature range, for example, a temperature range of 70° C. to 80° C., the coolant discharged from the cylinder heads 2*a*, 2*b* is directly recirculated to the second inlet passage portion 52 through the by-pass hose 532 and the thermostat T, instead of being returned to the radiator 4.

The second outlet passage portion 62 comprises a tube body for connecting the first and the third outlet passage portions 61, 63 defining openings respectively in the opposite side surfaces of the cylinder heads 2*a*, 2*b*.

The respective openings serve as a downstream end of the first passage portion 61 and an upstream end of the third outlet passage portion 63. The second outlet passage portion 62 is, as shown in FIG. 4, supported by a timing belt cover 131 besides the cylinder heads 2*a*, 2*b*. Accordingly, the second outlet passage portion 62 can be disposed between the banks 3*a*, 3*b* in such a manner as to pass through a space S made between the support portion 126 of the water pump 12 and the second inlet passage portion 52.

The third outlet passage portion 63, as shown in FIGS. 1 and 5, comprises a passage portion 63*a* defined integrally in the forward portion of the cylinder head 2*b* and a mounting tube body 63*b* formed into a U-shape when viewed from the top. As shown in FIG. 5, a downstream end 630 of the passage portion 63*a* and an upstream end 641 of the fourth outlet passage portion 64 are respectively defined in the front face of the cylinder 2*b*. The mounting tube body 63*b* is so joined to the front face of the cylinder head 2*b* by a bolt 631 that the passage portions 63*a* and the fourth outlet passage portion 64 communicate with each other.

A bearing boss 632 is formed integrally at the front face of the mounting tube body 63*b* with projecting forwardly of the mounting tube body 63*b*. The bearing boss 632 is adapted for rotatably supporting the idle pulley 16. On the outer surface of the mounting tube body 63*b* is formed a mounting boss 633 (see FIG. 1) projecting outwardly of the mounting tube body 63*b* and the bolt 631 is through the mounting boss 633 screwed into the cylinder head 2*b*. Between the front face of the mounting boss 633 and the bearing boss 632 is integrally and slantingly formed an outer rib 634. On the inner surface of the third outlet passage portion 63 is formed an inner rib 635 in a position corresponding to the outer rib 634. Accordingly, the outer and inner ribs 634, 635 are formed integrally with their respective slanting faces being in parallel to each other.

The fourth outlet passage portion 64 comprises a passage portion defined in the cylinder head 2*b* and an outlet end portion 643 projecting outwardly of the cylinder head 2*b*, the passage portion and the outlet end portion 643 communicating with each other. The fourth outlet passage portion 64 communicates with the mounting tube body 63*b* through the upstream end 641 thereof. Near the upstream end 641 of the fourth outlet passage portion 64 is formed an coolant outlet 642 for discharging the coolant from the unillustrated water jackets of the cylinder head 2*b*, the outlet 642 being opened to the fourth outlet passage portion 64. The coolant discharged from the coolant outlet 642 joins the flow of the liquid coolant discharged from the cylinder head 2*a*.

In the V-shaped engine having the passage structure for coolant thus constructed, the first and the second inlet passage portion 51, 52 of the inlet passage 5 are defined with smoothly curved so as to minimize the flow resistance therein, with the result that the space S is created between the forward end portion of the cylinder block and the defining portion of the inlet passage 5. However, in the above embodiment, the space S is made use of in accommodating the second outlet passage portion 62, thereby enabling the engine to be constructed compactly compared to a case where the outlet passage extending over the banks 3*a*, 3*b* is arranged, for example, projecting forwardly of the banks 3*a*, 3*b*.

Further, the water pump 12 has the support portion 120 formed integrally to support the idle pulley 121 for the timing belt 13. Accordingly, the position of the idle pulley 121 can be readily fixed relative to the banks 3*a*, 3*b* without the use of other special bracket tailored for that purpose. In addition, since the support portion 126 is formed integrally with the pumping housing 123 of the water pump 12, parts such as the idle pulley 121 heated by the rotation thereof can be indirectly cooled by the coolant in the water pump 12, thereby improving the reliability of the idle pulley 121.

Moreover, in the above embodiment, the mounting tube body 63*b* constituting the outlet passage 6 has the bearing boss 632 for the idle pulley 16 formed integrally therewith, obviating the need for a bracket for supporting the idle pulley 16. Therefore, the arrangement of the idle pulley can be simplified. In addition, the idle pulley 16 can be indirectly cooled by the coolant passing through the outlet passage 6, thereby improving the reliability thereof. Further, since the outlet passage 6 is arranged in the offset space 32*b* provided in the bank 3*b*, the overall length of the engine can be reduced compared to a case where the outlet passage is arranged projecting forwardly of the front face of the cylinder heads 2*a*, 2*b*. Accordingly, the engine can be made compact.

Furthermore, in the mounting tube body 63*b*, the outer and the inner ribs 634, 635 are integrally formed between the mounting boss 633 and the bearing boss 632. Such ribs reinforce the strength of the bearing boss 632 so as not to bend. Accordingly, the bearing boss 632 can be reliably maintained in an appropriate state. In addition, by forming the inner rib 635, the surface of the mounting tube body 63*b* contacting with the coolant is increased, thereby improving the cooling effect of the bearing boss 632.

FIG. 7 is a cross sectional view showing a second embodiment in which the fourth outlet passage portion 64 (see FIG. 5) in the first embodiment is modified. A fourth outlet passage portion 64*a* of the second embodiment has an coolant outlet 642*a* for discharging coolant from a second cylinder head, the coolant outlet 642*a* disposed downstream of a communicating portion of the fourth outlet passage portion 64*a* with a mounting tube body 63*b*. The coolant outlet 642*a* is arranged so as to open to a linear passage portion 644 in an intermediate position thereof. Also, the coolant outlet 642*a* is formed so that the coolant discharged from the second cylinder head is joined into the flow of the coolant discharged from a first cylinder head in a slanting direction along the flow direction in the outlet passage portion 64*a*.

In the second embodiment thus constructed, the coolant from the mounting tube body 63*b* has a flow direction thereof changed approximately perpendicularly near an upstream end portion 641 of the fourth outlet passage portion 64*a*. Thereafter, the coolant passes through the passage portion 644 extending linearly up to an outlet end portion 643. In the halfway of the linear passage portion 644, the coolant from the coolant outlet 642*a* joins into the flow of the coolant from the mounting tube body 63*b* with creating almost no flow resistance. Accordingly, compared to a case where the flow of the coolant from the mounting tube body 63*b* and the flow of the coolant from the coolant outlet 642 join into each other with substantially opposing to each other as seen in the first embodiment, the second embodiment demonstrates less flow resistance at the time when the coolant flows meet, thereby reducing the load on a motor for feeding the coolant.

As described above, according to the invention, an outlet passage is arranged so as to pass between an inlet passage and an idler between a right bank and a left bank, thereby enabling a V-shaped engine to be made compact utilizing a space defined between the inlet passage and the idler.

Also, according to the invention, a junction portion is formed in a portion in front of the most forward cylinder of one row of cylinders being shifted rearward relative to the other row of cylinders, so that an outlet passage does not project forwardly of the front face of the cylinder heads, thereby providing a compact engine.

Further, a bearing portion formed on the outlet passage can accommodate an idle pulley for supporting a belt for engine accessaries, thereby eliminating the need for a bracket or the like for disposing the idle pulley and providing an optimum and simplified arrangement of the outlet passage and the idle pulley. In addition, the idle pulley can be effectively cooled by the coolant in the outlet passage, improving the reliability thereof.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A V-shaped engine comprising:

a cylinder block;

a pair of a first bank and a second bank, the pair having a V-shape in respect of a crosswise plane thereof, the first bank being formed by a first cylinder head and a first top half portion of the cylinder block supporting the first cylinder, the second bank being formed by a second cylinder head and a second top half portion of the cylinder block supporting the second cylinder;

an water pump provided on a front end portion of the cylinder block;

an inlet passage for introducing coolant into the water pump, the inlet passage extending in a vertical direction in a space between the first bank and the second bank;

a timing belt idler provided in front of the space; and an outlet passage for discharging the coolant from the first bank and the second bank, the outlet passage extending in a transverse direction over front faces of the first bank and the second bank and passing between the timing belt idler and the inlet passage.

2. A V-shaped engine as defined in claim 1 wherein the inlet passage has a smoothly curved middle portion projecting in a rearward direction.

3. A V-shaped engine as defined in claim 1 wherein the water pump has a casing formed with a bearing portion for supporting the timing belt idler.

4. A V-shaped engine as defined in claim 1 further comprising an engine accessary idler, wherein the outlet passage has a wall formed with a bearing portion for supporting the engine accessary idler.

5. A V-shaped engine as defined in claim 1 wherein the first bank has a first row of cylinders, and the second bank has a second row of cylinders, the first row of cylinders and the second row of cylinders being arranged so as to offset to each other in a lengthwise direction of the engine, the second row of cylinders being positioned rearward relative to the first row of cylinders; and the outlet passage has a first outlet passage for discharging the coolant from the first bank, a second outlet passage for discharging the coolant from the second bank, and a junction portion formed in a portion of the second bank which is in front of the most forward cylinder of the second row, the first outlet passage and the second outlet passage joining into the junction portion.

6. A V-shaped engine as defined in claim 5 further comprising an engine accessary idler, wherein the first outlet passage has a curved passage member right upstream of the juncture portion, the curved passage member being removably mounted to the front face of the cylinder heads and formed with a bearing portion for supporting the engine accessary idler and a boss for mounting the curved passage member to the cylinder heads.

7. A V-shaped engine as defined in claim 6 wherein the curved passage member has a rib extending to the bearing portion.

8. A V-shaped engine as defined in claim 5 wherein the junction portion has a linear passage portion extending in a sidewise direction, an outlet of the second outlet passage being formed in an intermediate portion of the linear passage portion in such a direction that the flow of coolant from the second outlet passage obliquely joins into downstream of the flow of coolant from the first outlet passage.

9. A V-shaped engine comprising:

a first bank including a first cylinder head, a first row of cylinders, and a first outlet passage for discharging the coolant from the first bank;

a second bank including a second cylinder head, a second row of cylinders, and a second outlet passage for discharging the coolant from the second bank, the first row of cylinders and the second row of cylinders being arranged so as to offset to each other in a lengthwise direction of the engine, the second row of cylinders being positioned rearward relative to the first row of cylinders; and a junction portion formed in a portion of the second bank which is in front of the most forward cylinder of the second row, the first outlet passage and the second outlet passage joining into the junction portion.

10. A V-shaped engine as defined in claim 9 further comprising an engine aocessary idler, wherein the first outlet passage has a curved passage member right upstream of the juncture portion, the curved passage member being removably mounted to the front face of the cylinder heads and formed with a bearing portion for supporting the engine accessary idler and a boss for mounting the curved passage member to the cylinder heads.

11. A V-shaped engine as defined in claim 10 wherein the curved passage member has a rib extending to the bearing portion.

12. A V-shaped engine as defined in claim 9 wherein the junction portion has a linear passage portion extending in a sidewise direction, an outlet of the second outlet passage being formed in an intermediate portion of the linear passage portion in such a direction that the flow of coolant from the second outlet passage obliquely joins into downstream of the flow of coolant from the first outlet passage.

* * * * *